US010900623B2

(12) United States Patent
Porter

(10) Patent No.: US 10,900,623 B2
(45) Date of Patent: Jan. 26, 2021

(54) METHODS AND APPARATUS FOR ILLUMINATING LANDSCAPE

(71) Applicant: Catapult Engineering, LLC, Fort Collins, CO (US)

(72) Inventor: Robert Porter, Fort Collins, CO (US)

(73) Assignee: Catapult Engineering, LLC, Fort Collins, CO (US)

( * ) Notice: Subject to any disclaimer, the term of this patent is extended or adjusted under 35 U.S.C. 154(b) by 0 days.

(21) Appl. No.: 16/399,647

(22) Filed: Apr. 30, 2019

(65) Prior Publication Data

US 2020/0348002 A1 Nov. 5, 2020

(51) Int. Cl.

| | |
|---|---|
| ***F21S 8/02*** | (2006.01) |
| ***F21V 21/22*** | (2006.01) |
| ***F21S 8/08*** | (2006.01) |
| ***F21V 21/15*** | (2006.01) |
| ***F21W 131/109*** | (2006.01) |

(52) U.S. Cl.

CPC ..... *F21S 8/028* (2013.01); *F21S 8/083* (2013.01); *F21V 21/15* (2013.01); *F21V 21/22* (2013.01); *F21W 2131/109* (2013.01)

(58) Field of Classification Search

CPC ..... F21V 21/22; F21W 2131/109

See application file for complete search history.

(56) References Cited

U.S. PATENT DOCUMENTS

| | | | | |
|---|---|---|---|---|
| 5,550,727 | A * | 8/1996 | Fenyvesy | F21S 8/022 362/285 |
| 5,683,176 | A * | 11/1997 | Clendenin | E01F 13/046 362/285 |
| 6,523,982 | B1 * | 2/2003 | Haddad | F21S 8/088 362/267 |
| 7,261,443 | B1 * | 8/2007 | Hayes, Jr. | F21S 2/00 362/285 |
| 8,186,857 | B2 | 5/2012 | Porter | |
| 8,454,208 | B2 | 6/2013 | Porter | |

(Continued)

*Primary Examiner* — Bryon T Gyllstrom
*Assistant Examiner* — Eric T Eide
(74) *Attorney, Agent, or Firm* — Santangelo Law Offices, P.C.

(57) ABSTRACT

Apparatus and methods are disclosed which may keep retractable landscape lamps substantially free from water intrusion in operation for a variety of embodiments. Retractable lamps may have a lower fixed portion which could be buried in the ground and an upper portion which may rise and illuminate. When the upper portion rises it may create a low pressure or vacuum inside. Water may be pulled into the lamp which may lead to failure. The lamp may benefit from a seal between the lower and upper portions. A seal may consist of a flexible rubber material and a grease or other lubricant which may form a watertight seal with low friction. The upper portion may have a cap with provisions for aspiration. While traveling between the retracted and extended positions the lamp may aspirate through the bottom of this cap. The cap may be designed to trap an air reservoir when it retracts. It may then provide air for aspiration the next time the lamp rises to permit such a rise such as above wet conditions or above standing water. The cap may have a protective vent which may allow air to pass while restricting water from passing.

21 Claims, 4 Drawing Sheets

(56) References Cited

U.S. PATENT DOCUMENTS

2012/0250337 A1* 10/2012 Pike ..... F21S 8/028
362/418
2013/0121006 A1* 5/2013 Moshtagh ..... F21V 31/005
362/373

* cited by examiner

METHODS AND APPARATUS FOR ILLUMINATING LANDSCAPE

FIELD OF THE INVENTION

The present invention may relate to landscape illumination methods and systems. It may further relate to illumination systems and methods in water or wet conditions, and may provide a dry landscape lamp in all conditions.

BACKGROUND OF THE INVENTION

There may be an existing market desire for retractable landscape lamps. Like lawn sprinklers, when not in use it may be desirable to have them retract. This may prevent trip hazards and theft while preserving the beauty of a lawn during the day and may also make mowing easier. There have been other attempts to design and provide retractable landscape lamps. However, one obstacle which may have limited widespread use is the intrusion of water. The present invention solves this problem through novel designs and processes.

SUMMARY OF THE INVENTION

There are several related but independent objects of this invention. Embodiments of the present invention may include elements that achieve a goal of protecting a range of retractable landscape lamps from "inhaling" water during the period when an upper portion rises, utilizing common elements between various lamp designs. One object is to provide practical landscape light designs that can address the obstacle of water intrusion. Another is to provide retractable landscape light features which can be adapted to and used in a variety of designs. Another object is to make a low voltage landscape light which may act to solve effects of water intrusion when in operation. Another object is to make a reliable retractable lamp design that works in existing power and battery environments. Naturally, other objects and goals exist and are indicated through the following descriptions and embodiments.

DETAILED DESCRIPTION OF THE EMBODIMENTS

It should be understood that the present invention includes a variety of aspects, which may be combined in different ways. The following descriptions are provided to list elements and describe some of the embodiments of the present invention. These elements are listed with initial embodiments; however, it should be understood that they may be combined in any manner and in any number to create additional embodiments. The variously described examples and preferred embodiments should not be construed to limit the present invention to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments is not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Embodiments of the present invention may include elements that may be required to protect a range of retractable landscape lamps (100) from inhaling water during the period when the upper portion rises, utilizing common elements between various lamp designs.

Figure 1:
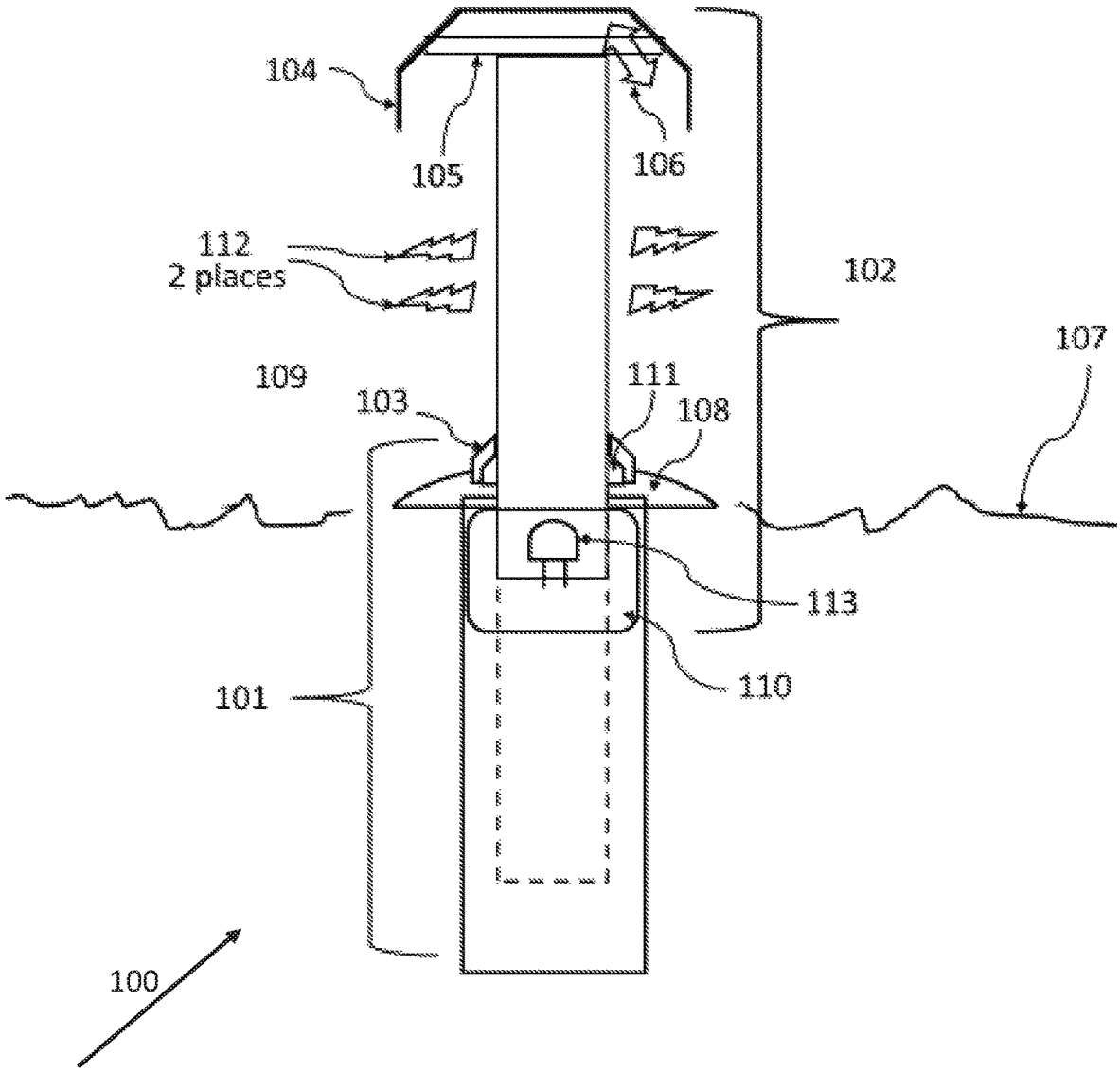
FIG. 1 shows a cross-section of a retractable landscape lamp in an extended position which may emit light horizontally, and in accordance with some of the embodiments described herein.

The present invention may have at least two portions. A lower fixed portion may typically be buried in the ground or a base medium. A second portion may typically include the part of the lamp which rises. As shown in FIG. 1, an embodiment of the present invention may include a lower portion (101) and ground level (107). In certain embodiments, the lower portion (101) may have a flange (108) on the top indicating ground level. The flange may also be the support for a seal (103), discussed later. The upper portion (102) is shown in its extended position in FIG. 1. The upper portion may rise and illuminate when energized and may retract down (and possibly extinguish) into the lower portion when not energized. The rising shaft (109) may have various forms and purposes. In one embodiment this piece can be a diffusion tube. This tube may be a cylindrical frosted polycarbonate diffusion tube. In certain embodiments, a light (112) may be radiated horizontally from this tube. In other embodiments, the rising shaft (109) could be an opaque tube providing structural support for the cap which may then contain the light emitting source. In either case, this tube may be open at the top and bottom to allow air to freely move between the lower and upper portions. Certain embodiments may include a multipurpose drive and control mechanism (110). The electronics and LEDs that may be included as a part of this mechanism may need to be kept dry. There may be a seal (103) between the upper tube (109) and the lower portion which may prevent water from entering, for example, when the lamp rises. At the top of the upper portion there may be a cap (104). When the lamp retracts this cap may capture an air reservoir. Located in the cap may be a protective vent (105) which may allow air to pass (106), but may not allow water to pass.

Figure 2:
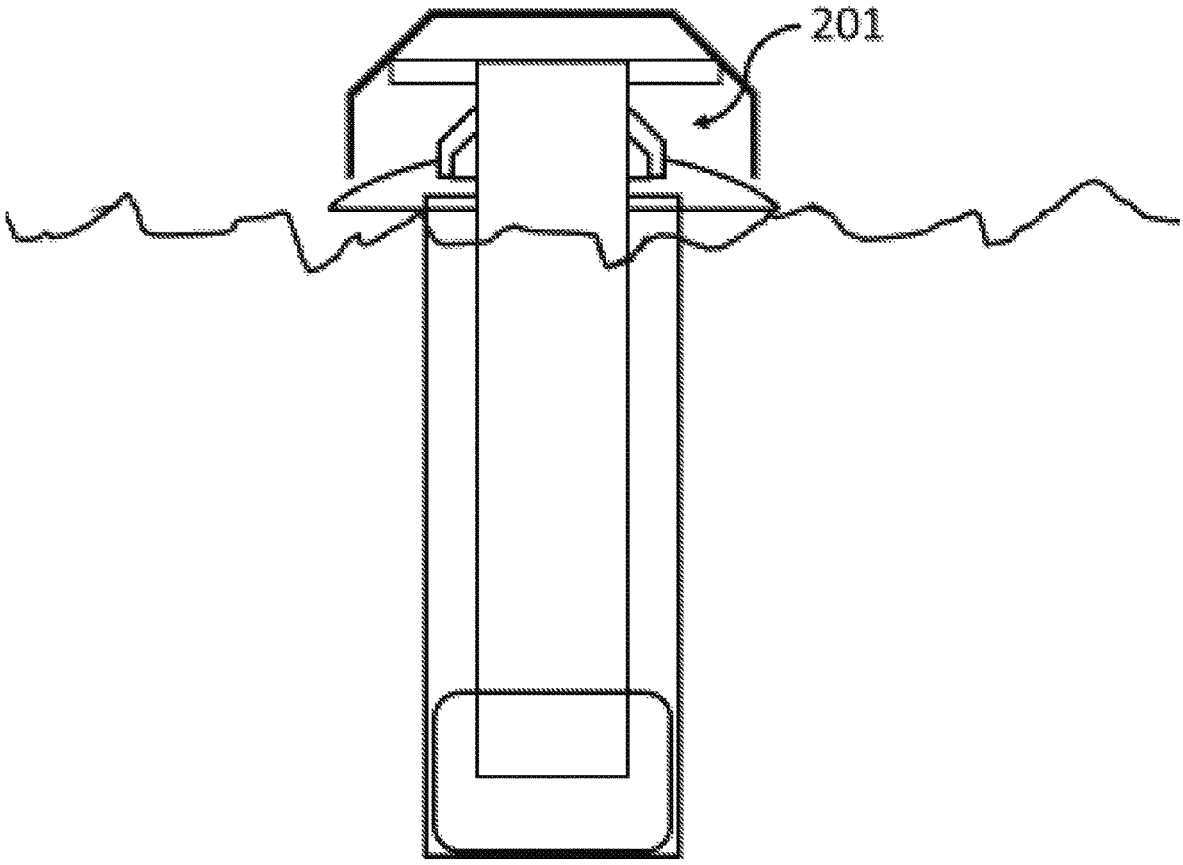
FIG. 2 shows a retractable landscape lamp in a retracted position, possibly after trapping an air bubble (201) and in accordance with some of the embodiments described herein.

The embodiment shown in FIG. 1 is shown in an extended position during which it may produce a desired lighting. The embodiment shown in FIG. 2 may see the lamp in its retracted position safely out of the way. In prior art, moving may have been troublesome. When a lamp rises, it may create a vacuum inside which may cause water entry. What may be needed is a lamp with the ability to aspirate while rising and falling without inhaling water. As a retractable lamp rises and falls, the internal volume of the lamp may change. A retractable lamp may need a way to aspirate or breathe during the rising and falling of the lamp, without the intrusion of water. This aspiration may have not been successfully dealt with in prior art. The most critical aspect of aspiration may occur when the lamp rises. It may be at this time that a reduced air pressure or vacuum may occur internal to the lamp. If there is no means for safely inhaling air, water may be pulled inside. Embodiments of the present invention may provide a combination of apparatus and methods to keep water from entering the lamp—especially when the lamp is rising and/or falling. Embodiments of the present invention can include several elements including as but a few examples: an effective seal which may include: material properties, a grease reservoir (111), aspiration from beneath a top cap, an air reservoir, and possibly even a protective vent. It may be most reliable when all are present but as will be discussed herein, there are various possibilities. One goal of this invention may be to enable a common base and drive mechanism which may support many embodiments—such as of the upper portion or otherwise. In certain embodiments, one may observe in FIGS. 1 and 3 that while the upper portion may be fundamentally different between the two lamps, the lower portion, possibly including the drive mechanism may be identical (except for possibly the opening in the seal contained in the flange). In this way, a family of retractable landscape lamps may be enabled. Keeping the electronics dry may be important. The elements of this invention may be useful over a broad variety of shapes and sizes of lamps. There may be many potential embodiments which include the elements of this invention. One embodiment of the lamp shown in FIG. 1 is disclosed. In this embodiment, the vertical tube (109) may be a frosted polycarbonate diffuser. Other transparent or semitransparent materials may serve as well such as an acrylic tube, as but one example. The frosting may be homogenous or could also be a frosted material or treatment inserted in a clear tube. In FIG. 1 LED light(s) (113) may be placed in the bottom of this tube. These LEDs may have a narrow radiation pattern which may provide a uniform distribution of light emission along the vertical length of the diffusion tube. A reflecting surface may also be included in the cap which may improve the uniformity of the light emission along the vertical length of the diffusion tube. Inside the control and drive mechanism (110) may be: circuitry to accomplish driving LEDs, bidirectional motor drive with torque limits, and a battery charger, among other elements. This circuitry may rely on earlier U.S. Pat. Nos. 8,186,857 and 8,454,208, both hereby incorporated by reference. For certain embodiments, the drive mechanism may generally be known or for the lamp of FIG. 1, it may be a rack and pinion gear.

Figure 3:
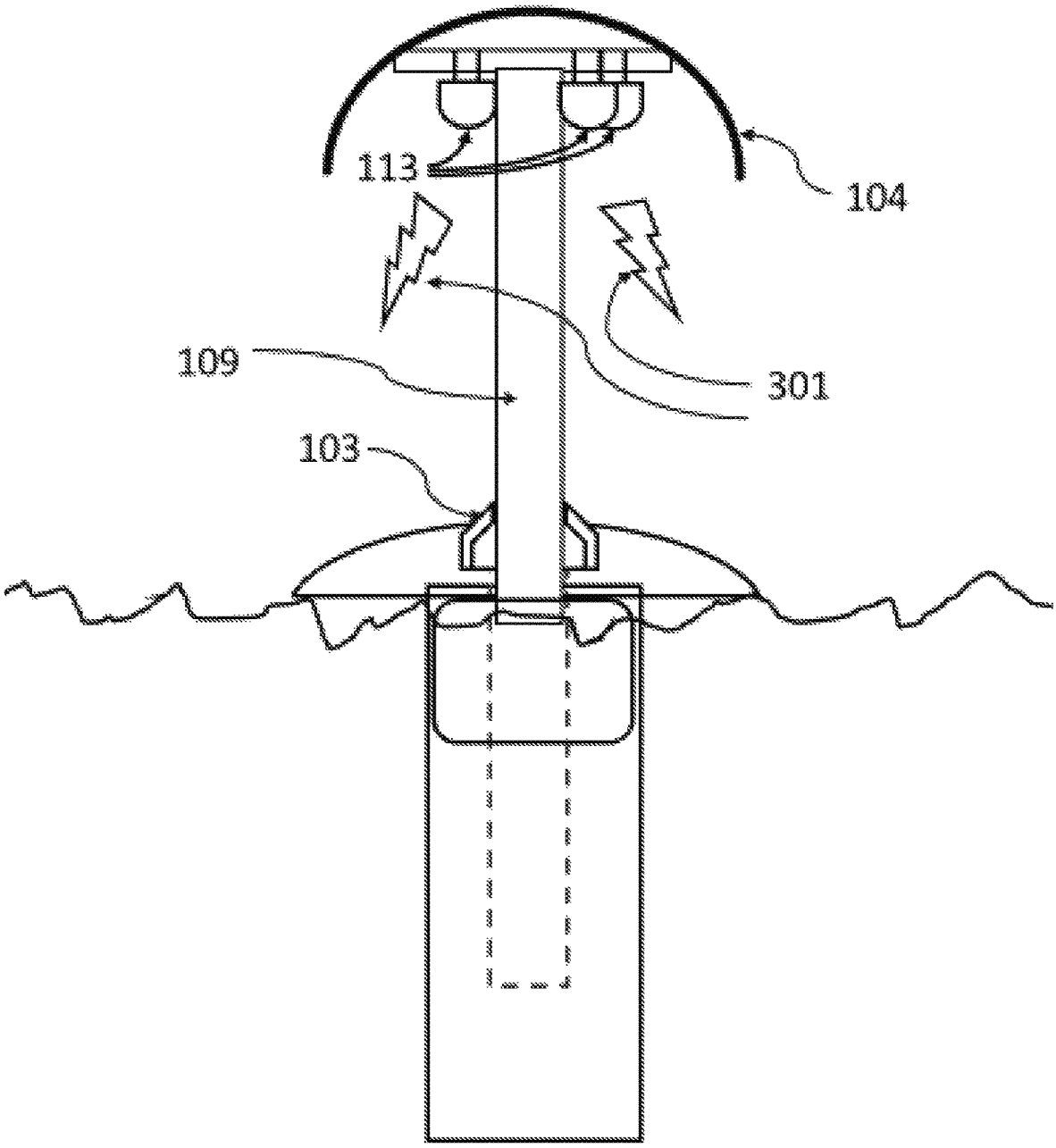
FIG. 3 shows an alternate embodiment of a retractable landscape lamp, possibly providing downward illumination, and in accordance with some of the embodiments as described herein.

It may be desirable to have lamps of differing designs be retractable and water resistant. Certain embodiments, such as those disclosed in FIG. 1 may emit light (112) in a horizontal direction. If one desired to have the light downward, a different embodiment may be considered such as shown in FIG. 3. Here, the LED lights (113) can be located in the cap, possibly beneath the protective vent. The elements of invention disclosed may be incorporated in many lamp designs, which may enable them to be retractable and water resistant in a reliable manner. For example, in certain embodiments, the diffusion tube (109) could be replaced by an opaque metal tube which may serve for mechanical support in addition to possibly a passageway for air, and for wires to the cap. The opaque tube may still benefit from the disclosed seal. The seal shown in FIG. 3 may have a smaller diameter. This may simply be an aesthetic factor, or may serve other functions. Many shapes of caps could also benefit from elements of the invention. In certain embodiments, such as those shown in FIG. 3, an upright post (109) may occupy the position of the diffusion tube (109) of FIG. 1. The seal (103) may be modified for a smaller-diameter upright tube. The cap (104) may also take advantage of the elements of the invention, perhaps by including a vent and air reservoir. In certain embodiments, the tube and cap could be any material, for example, copper. In alternate embodiments, LEDs could be mounted in the cap with the same functional vent (105) and air reservoir (201) as shown in FIG. 1. In each case there may be differing mechanical dimensions and materials. The aesthetics of a lamp design may be allowed to determine these properties. The lamps disclosed may share a common lower portion and drive mechanism. This may enable a low-cost way for lamp designers to focus on other aspects of product development, including the aesthetic aspects of design, for example.

In FIG. 1 one may observe a seal (103) which may be located in the flange (108) at the junction of the lower portion and the upper portion. This seal may be watertight while also possibly providing low static and moving friction. If required, these may be difficult to achieve simultaneously, and may be the reason no one appears to have made a successful retractable landscape lamp to date. A solution may have a few important aspects as will be discussed.

The seal material may be a soft rubber-like material which may be flexible enough to follow the contours of the vertical tube (109). The ideal seal may also have a grease reservoir (111), possibly to provide lubricant. The grease may provide two functions in that it may reduce the friction and it may provide an actual final seal element possibly between a rubber seal and a moving vertical shaft. With this combination there may be a constant presence of a very thin layer of grease in place. In certain embodiments, the seal may ideally be formed by use of a conical shape, possibly with a thin lip lying against the diffusion tube. In certain embodiments, when the upper portion (102) rises, the vacuum on the inside and pressure on the outside of the lamp may force the seal to press against the diffusion tube (109).

In alternate embodiments the seal may be constructed from a soft rubber-like material. It could be rubber, nitrile, butyl or any other similar material. A seal may have metal inserts, possibly to help maintain its shape. An effective seal may also make use of a light grease.

Embodiments may include a diffusion tube or shaft (109) that may have a hard, smooth exterior surface for the seal to work well. In one embodiment, this material may be a frosted polycarbonate diffusion tube. In another embodiment, an opaque polished metal rod might be used. In embodiments where a rod is opaque, the lamp can be configured to have the light emitted from beneath the cap.

In certain embodiments it may desirable for the seal to enable low static and moving friction. Low voltage distributed lamps may normally be operated with a low power input especially with LED bulbs. To make the action of raising and lowering the lamps reliable it may be necessary to keep the seal friction low compared to the capability of the drive mechanism. For example, a drive mechanism capable of pushing 10 to 15 pounds may be economically feasible. The maximum static friction for certain embodiments may have a seal requiring, for example, no more than about two pounds of force to get moving. This margin may provide a long-term reliable action.

Other embodiments may include a perhaps surprising optimal diametrical ratio between the diffusion tube to the rubber seal, which may be in the range of about 97.4% to 98.1%. In yet other embodiments, a diametrical ratio between about 97% and 98.5% may be adequate. This peculiar ratio may allow for the non-uniformity of an extruded polycarbonate diffusion tube and perhaps for the tolerance of a common seal, possibly to maintain a water-tight seal and possess low static and moving friction. Desired diametrical tolerances may provide perhaps a motorcycle shock type dust seal which may be utilized for this application.

Embodiments of the present invention may include a cap (104) which may be configured for visual attractiveness or otherwise, a mounting base for the vent, and an air storage device, among other items. The shape can be optimized for air storage, perhaps having a large diameter. In embodiments where there is standing water, the lamp may retract the cap and capture an air bubble. This reservoir of air can be designed so it may normally remain intact, possibly until the next time the lamp rises. In embodiments where the lamp rises while there is standing water, the lamp may inhale air from this reservoir until such time as the cap rises above the standing water.

Other embodiments may include a protective vent assembly (105) perhaps in one embodiment which may utilize a larger area of selected fabric, selected to pass air (106) and not water. It may be constructed with a support member (401, 402). There may also be many mechanical embodiments possible. In embodiments that include a horizontal structure (401), it could be designed to fit around the diffusion tube. In one embodiment, the vent fabric could be, for example, a washer shape glued over the holes in the support and near the outside diameter. The structure's outside surface may be attached to the cap. This may force aspiration (106) through the vent fabric. It may be affixed between the top of the diffusion tube (109) and the cap (104). There may be fabrics of various capabilities which possess this attribute. Protective vent fabric may be porous with holes large enough for air molecules to pass, but possibly not large enough for substantial water, or water droplets, to pass. In this way, substantially only air may be allowed to pass or the volume may be substantially free of water. The vent material might be made from rapidly stretched Teflon, as but one example.

There may be existing manufacturers of protective vents for outdoor electronics enclosures. However, these vents may not be recommended for assemblies that include moving parts. They may be primarily designed to be installed on outdoor equipment to address atmospheric temperature changes and they may keep electronics inside the enclosure substantially dry. For an application including a piston action, these seals may not be well-suited, possibly due to a required airflow beyond their capacity. Embodiments of the present invention may include moving parts and a new architecture, possibly with a special cap designed to have a large cross-sectional area to accommodate a relatively larger or giant vent. In certain embodiments, desired products may have a vent larger than about 5 square centimeters, and perhaps as large as about 18 square centimeters. The drive velocity may be coordinated or perhaps lowered which may reduce the rate of airflow and thus needed or preferred vent size. In an embodiment of the present invention, the up or down transition may take about two, four, six, eight, or even ten seconds with the indicated size of vent scaled for the overall lamp size as can be understood.

Figure 4:
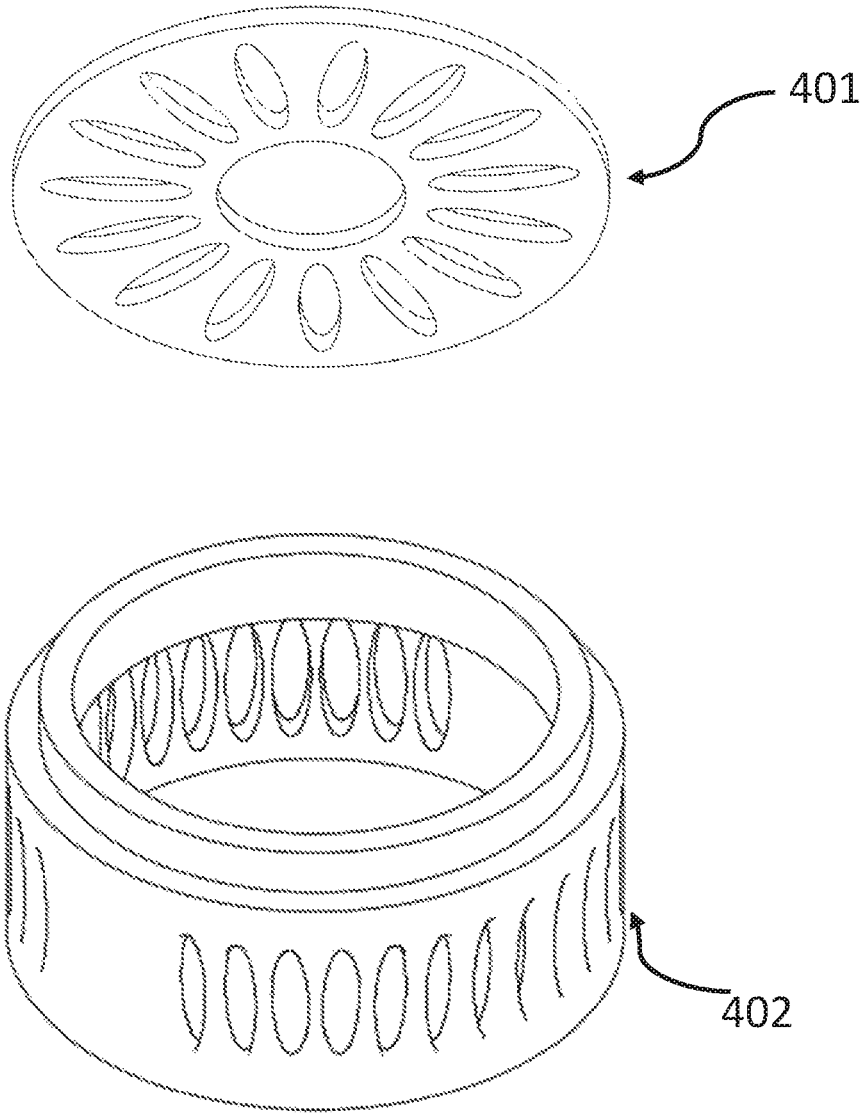
FIG. 4 shows an embodiment of a retractable landscape lamp containing two possible vent supports, a horizontal support and a vertical support, and in accordance with some of the embodiments as described herein.

In yet other embodiments, a mount structure may be useful for the vent as the material may be flexible—which may help its function over time and it may benefit from support. The vent fabric may typically be attached to this structure, perhaps with an adhesive, around the perimeter of the vent area. FIG. 4 shows two potential support structures, a horizontal one (401) and a vertical one (402). Either may be used. The vertical support may have an advantage in that water or debris naturally rolls off due to gravity or it can be scraped clean during operation. The horizontal support may fit easier beneath the cap, depending on aesthetic design priorities.

In certain embodiments there may be ground water present such as in wet conditions, which the lamp may "inhale". Some of these embodiments may include standing water higher than the top of the cap. In embodiments that include standing water above the cap the following sequence may still occur safely.

An extended lamp may retract. A cap may then trap an air bubble. This air reservoir may remain until the next rise cycle. When the lamp begins to rise, there may immediately be a vacuum inside the lamp. This vacuum may cause the seal to push more tightly against the rising tube. Utilizing grease may provide a perfect final seal.

In certain embodiments, a lamp may aspirate from the bottom of the cap (104), which may be located on the top of the lamp. Perhaps at the moment the lamp begins to rise, it may then utilize the air reservoir (201) beneath the top cap. The lamp may inhale this trapped air. The reservoir may be diminished by this action. Eventually the air bubble may be depleted. If the top of the lamp has not risen above the depth of the water, the lamp may be dependent on a protective vent to prevent water intrusion. It may be possible to make the top cap large enough such that the air bubble would suffice for the lamp to reach full extension. The air reservoir may be refreshed once above the water level.

Other embodiments of the present invention may include a protective vent. The vent may prevent water from passing, while possibly allowing air to pass. This may provide a secondary form of protection. If the lamp is in deep water, the vent may effectively make a seal against inhaling water, possibly until the water level retreats. It may also prevent water which may be sloshing around beneath the cap from being inhaled. When the lamp retracts, the action may be reversed. It may not be so critical from a water intrusion standpoint, as the lamp may now be "exhaling".

In embodiments that include stop valves in place such that the exhale was not allowed through the previously described path, the present invention may allow a pumping action. One could use the retraction of the lamp like a bicycle pump. One could put a tube from the bottom through a stop valve to the lamp exterior. The retraction force may pump any water existing in the bottom out of the lamp.

As can be easily understood from the foregoing, the basic concepts of the present invention may be embodied in a variety of ways. It involves both lamp operation techniques as well as devices to accomplish the appropriate lamp operation. In this application, the operator techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. As one example, terms of degree, terms of approximation, and/or relative terms may be used. These may include terms such as the words: substantially, about, only, and the like. These words and types of words are to be understood in a dictionary sense as terms that encompass an ample or considerable amount, quantity, size, etc. as well as terms that encompass largely but not wholly that which is specified. Further, for this application if or when used, terms of degree, terms of approximation, and/or relative terms should be understood as also encompassing more precise and even quantitative values that include various levels of precision and the possibility of claims that address a number of quantitative options and alternatives. For example, to the extent ultimately used, the existence or non-existence of a substance or condition in a particular input, output, or at a particular stage can be specified as substantially only a value (such as air) or substantially free of a value, (such as water), as a value of about a number (such as of a diameter), or such other similar language. Using percentage values as one example, these types of terms should be understood as encompassing the options of percentage values that include 99.5%, 99%, 97%, 95%, 92% or even 90% of the specified value or relative condition; correspondingly for values at the other end of the spectrum (e.g., substantially free of x), these should be understood as encompassing the options of percentage values that include not more than 0.5%, 1%, 3%, 5%, 8% or even 10% of the specified value or relative condition, all whether by volume or by weight as either may be specified. For example, using percentage values as one example, for the reservoir to be substantially only air, it should be understood that embodiments of the invention may encompass the option of percentage values that include 99.5%, 99%, 97%, 95%, 92% or even 90% being the desired air molecules element by volume or by weight or number. Correspondingly for values at the other end of the spectrum (e.g., substantially free of water), embodiments of the invention should be understood as encompassing the options of percentage values that include not more than 0.5%, 1%, 3%, 5%, 8% or even 10% as water molecules whether by volume or by weight. In context, these should be understood by a person of ordinary skill as being disclosed and included whether in an absolute value sense or in valuing one set of or substance as compared to the value of a second set of or substance. Again, these are implicitly included in this disclosure and should (and, it is believed, would) be understood to a person of ordinary skill in this field. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "seal" should be understood to encompass disclosure of the act of "sealing"—whether explicitly discussed or not—and, conversely, were there effectively disclosure of the act of "sealing", such a disclosure should be understood to encompass disclosure of a "seal" and even a "means for sealing." Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant (s).

Thus, the applicant(s) should be understood to have support to claim and make a statement of invention to at least: i) each of the illumination devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such processes, methods, systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws- to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A system for illuminating landscape comprising:

a. a retractable landscape lamp suitable for outdoor installation;

b. a lower fixed portion of said lamp;

c. an upper portion of said lamp;

d. an aspiration path that draws or removes air from a light source through the upper portion of said lamp to an area outside of the lamp but not substantial amounts of water, and i. said aspiration path including a protective vent assembly which allows the air to pass and prevent water from passing;

e. sealing elements in said lamp;

i. wherein said sealing elements substantially prevent the intrusion of water into the interior of said lamp during the period when the lamp rises in wet conditions.

2. The system for illuminating landscape of claim 1, wherein said protective vent assembly comprises a vent fabric.

3. The system for illuminating landscape of claim 1, further comprising an electronic drive and control mechanism that causes motion of said upper portion of said lamp.

4. The system for illuminating landscape of claim 1, wherein said sealing element comprise a rubber seal and grease.

5. The system for illuminating landscape of claim 4, wherein said rubber seal and grease are located between said lower portion of said lamp and a vertical shaft in said upper portion of said lamp.

6. The system for illuminating landscape of claim 1, wherein said upper portion of said lamp has a cap with a bottom and wherein said retractable landscape lamp aspirates through the bottom of a cap into or out of said lower portion of lamp.

7. The system for illuminating landscape of claim 6, wherein said cap is located on a top of said retractable landscape lamp.

8. The system for illuminating landscape of claim 7, wherein said cap provides an air reservoir which traps an air bubble below said cap that is refreshed during a prior retraction of said retractable landscape lamp.

9. The system for illuminating landscape of claim 1, wherein said sealing elements include a protective vent material which passes air and substantially prohibits passing of water.

10. The system for illuminating landscape of claim 9, wherein said protective vent material aspirates from outside lamp into lower portion and has an area selected from a group consisting of:

a. larger than 4 square centimeters;

b. larger than 5 square centimeters;

c. larger than 6 square centimeters; and d. an area coordinated with the speed of operation of said lamp.

11. A method of illuminating landscape comprising the steps of:

a. providing a retractable landscape lamp;

b. providing moving parts of said retractable landscape lamp;

c. providing an electronic drive and control system, d. keeping water out of said retractable landscape lamp;

e. providing an effective seal for said moving parts of said retractable landscape lamp; and f. providing a path for aspiration that draws or removes air from a light source through the upper portion of said lamp to an area outside of the lamp but not substantial amounts of water from near the top of said retractable landscape lamp into the interior of the lamp;

i. said aspiration path including a protective vent assembly which allows the air to pass and prevent water from passing.

12. The method of illuminating landscape according to claim 11, further comprising the steps of:

a. providing a cap on the top of said retractable landscape lamp;

b. providing the protective vent in said cap; and c. aspirating through said protective vent in said cap during operation.

13. The method of illuminating landscape according to claim 12, wherein said cap traps an air reservoir as an air bubble below said cap during a retraction action of said retractable landscape lamp.

14. A method of illuminating landscape comprising the steps of:

a. providing a plurality of retractable landscape lamps; and b. aspirating to draw or remove air from a light source through the upper portion of said lamp to an area outside of the lamp but not substantial amounts of water from each of said retractable landscape lamps;

i. said aspiration path including a protective vent assembly which allows the air to pass and prevent water from passing;

c. keeping a lower portion and an upper portion of said plurality of retractable landscape lamps substantially free of water intrusion by operation of said lamps.

15. The method of illuminating landscape as described in claim 14, further comprising the step of sealing said lower portion and said upper portion.

16. The method of illuminating landscape as described in claim 15, further comprising the step of capping the top of the lamp for aspiration.

17. The method of illuminating landscape as described in claim 16, wherein said step of capping the top of the lamp for aspiration further comprises the step of venting within said capping.

18. The method of illuminating landscape as described in claim 17, further comprising the step of utilizing a common design lower portion.

19. The method of illuminating landscape as described in claim 14, wherein said step of providing a plurality of retractable landscape lamps comprises the step of providing a plurality of motor driven retractable landscape lamps.

20. The method of illuminating landscape as described in claim 17, wherein said venting comprises the protective venting.

21. The method of illuminating landscape as described in claim 14, wherein said step of aspirating to draw or remove air but not substantial amounts of water comprises the step of passing air through a vent fabric.

* * * * *